US010427279B2

(12) United States Patent
Rensburg

(10) Patent No.: US 10,427,279 B2
(45) Date of Patent: Oct. 1, 2019

(54) SCREW INSTALLATION AID FOR HOLDING AND ALIGNING A SCREW

(71) Applicant: Markus Rensburg, Hagen (DE)

(72) Inventor: Markus Rensburg, Hagen (DE)

( * ) Notice: Subject to any disclaimer, the term of this patent is extended or adjusted under 35 U.S.C. 154(b) by 144 days.

(21) Appl. No.: 15/837,043

(22) Filed: Dec. 11, 2017

(65) Prior Publication Data

US 2018/0161966 A1 Jun. 14, 2018

(30) Foreign Application Priority Data

Dec. 14, 2016 (DE) ..... 20 2016 007 588 U

(51) Int. Cl.

| | |
|---|---|
| ***B25B 23/00*** | (2006.01) |
| ***B25B 5/06*** | (2006.01) |
| ***B25B 23/08*** | (2006.01) |
| ***B25B 5/00*** | (2006.01) |
| ***B25B 23/10*** | (2006.01) |

(52) U.S. Cl.

CPC ..... *B25B 23/005* (2013.01); *B25B 5/003* (2013.01); *B25B 5/06* (2013.01); *B25B 23/08* (2013.01); *B25B 23/10* (2013.01)

(58) Field of Classification Search

CPC ..... B25B 23/005; B25B 23/08; B25B 23/10; B25B 5/02

See application file for complete search history.

(56) References Cited

U.S. PATENT DOCUMENTS

| | | | | |
|---|---|---|---|---|
| 5,685,732 | A * | 11/1997 | Lane | H01R 13/6392 24/523 |
| 8,672,204 | B2 | 3/2014 | Vandenberg | |
| 9,144,896 | B2 * | 9/2015 | Vandenberg | B25B 23/00 |
| 10,307,898 | B2 * | 6/2019 | Lin | B25B 23/08 |
| 10,322,499 | B2 * | 6/2019 | Mikkelsen | B25B 23/005 |
| 2010/0083610 | A1 * | 4/2010 | King | B25B 15/001 52/749.1 |

FOREIGN PATENT DOCUMENTS

| | | |
|---|---|---|
| DE | 200 02 567 U1 | 6/2001 |
| EP | 2 517 834 A2 | 10/2012 |
| EP | 3 064 321 A1 | 9/2016 |

OTHER PUBLICATIONS

German First Office Action in DE 10 2016 014 860.8, dated Aug. 23, 2017, with English translation of relevant parts.

German Second Office Action in DE 10 2016 014 860.8, dated Oct. 16, 2017, with English translation of relevant parts.

* cited by examiner

*Primary Examiner* — Hadi Shakeri

(74) *Attorney, Agent, or Firm* — Collard & Roe, P.C.

(57) ABSTRACT

A screw installation aid holds and aligns a screw in an inclined screw axis relative to the component to be screwed. At least one screw guide receives the screw in the inclined screw axis, and a screwing tool advances through an opening to the screw head coaxially to the screw axis, to install the screw in the component in its inclined position. The screw installation aid encompasses a telescopic cross-member including at least two support segments adjustable coaxially to one another, the undersides of which facing the component form a level and, before adaptation to the component, continuous support surface, each of the undersides bearing one of the clamping blocks. The clamping blocks can be positioned from a closing to an opening position against the resistance of a spring device between both support segments and a screw guide is enclosed in at least one of the support segments.

6 Claims, 2 Drawing Sheets

SCREW INSTALLATION AID FOR HOLDING AND ALIGNING A SCREW

CROSS REFERENCE TO RELATED APPLICATIONS

Applicant claims priority under 35 U.S.C. § 119 of German Application No. 20 2016 007 588.9 filed on Dec. 14, 2016, the disclosure of which is incorporated by reference.

BACKGROUND OF THE INVENTION

Field of the Invention

The invention relates to a screw installation aid for holding and aligning a screw in an inclined screw axis relative to the component to be screwed.

Description of the Related Art

In wood and dry construction, and particularly in the case of decking structures, it is necessary to insert screws into a component at an angle of 45°, for example, in order to connect the latter to the substrate. When fixing decking boards, the screws are usually driven in through the lateral longitudinal edge; if no auxiliary device is used this often means the screw will slip and not penetrate the component sufficiently far from the edge of the board. The consequence is that the board tears and splinters, impairing the fixing quality.

Screw gauges that specify the screwing angle are therefore used.

A fitting tool is known from U.S. Pat. No. 8,672,204 B2 that exhibits means by which a screw is held at a specific angle so that it can be screwed in this inclined position into the component to be screwed. The handling of this fitting tool is very unfavourable. First, the support surface available for placing the device on the component to be screwed is too small, and second, the handles to be used to clamp the component interfere with handling. During the screw installation process the device cannot be pressed against the component with appropriate force because the arrangement of these handles is not suitable for the transfer of force for the purpose of pressing the cross-member against the component. In addition, the counterpressure of the screwing tool used causes the fitting tool to lift away and tilt, with the result that the screw can only be installed imprecisely.

SUMMARY OF THE INVENTION

The present invention is based on the task of creating an easily handled screw installation aid that guarantees reliable working and can produce good working results.

This task is solved by a screw installation aid according to the invention.

Further advantageous details and embodiments of the invention as well as further developments and variants are evident from and explained in the following.

Advantages of the Invention

According to the invention a screw installation aid is proposed for holding and aligning a screw in an inclined screw axis relative to the component to be screwed, with at least one screw guide, in which the screw is received in the inclined screw axis, and which has an opening through which a screwing tool can be advanced to the screw head coaxially to the screw axis, in order to install the screw in the component in its inclined position, wherein the screw installation aid can be adapted to the component in that it possesses two clamping blocks that are adjustable relative to one another, the adjacent inner sides of which limit a clamping width and which, during the screwing process, clamp the component to be screwed.

The screw installation aid according to the invention is characterised in that it encompasses a telescopic cross-member that consists of at least two support segments that can be adjusted coaxially to one another, the undersides of which facing the component to be screwed form a level and, before adaptation to the component, continuous support surface and with each of the undersides bearing one of the clamping blocks, wherein the clamping blocks can be positioned from a closing to an opening position against the resistance of a spring device between both support segments and wherein a screw guide is enclosed in at least one of the support segments.

The invention allows e.g. a decking board to be fastened to a substructure through its side flank. The screw installation aid according to the invention ensures that the screw used for installation penetrates the decking board at precisely the specified angle and at the ideal screwing point. According to the invention this is supported by the fact that the screw installation aid can be pressed by hand and without tilting against the decking board to be installed. As a result, the device remains in the desired working position throughout the entire screwing process.

In an especially preferred embodiment of the invention it is envisaged that the screw axis passes through a window arranged in the adjacent clamping block. The clamping block sits parallel on the side flank of the component to be screwed, as a result of which the screw engages in the side flank of the component as desired upon passing through the window situated in the clamping block.

A further advantageous embodiment of the invention envisages that both support segments possess parallel end surfaces with which they rest against each other, wherein the support segments are joined together coaxially with a common clamping axis passing through them in a longitudinal direction. Both support segments together form a bar-shaped cross-member which cannot tilt when resting on the component to be screwed. The precise coaxial alignment of both parts relative to each another permits the telescopic linear adjustment of the parts.

A further advantageous embodiment of the invention envisages that the first support segment bears on its end surface a tubular pin, which extends in a longitudinal direction along the clamping axis, and the second support segment exhibits on its end surface an opening that receives the pin. This permits a precisely linear bringing together of both parts while maintaining their linear extension including during their axial adjustment.

This is supported in an especially preferred embodiment of the invention in that the tubular pin of the first support segment is received inside a chamber of the second support segment and can be moved coaxially relative to the common clamping axis.

An especially preferred embodiment of the invention envisages that the tubular pin within its tube chamber houses a spring, which is supported at one of its ends on the inner end wall of the pin and at its other end on a driver arranged on the inner wall of the chamber of the second support segment. In this connection the driver of the second support segment is guided in a slot that penetrates the wall of the pin of the first support segment, and protrudes into the tube chamber of the tubular pin.

Both cross-member sections thus obey a spring device that can force the support segments permanently into their closed position, i.e. into the clamped position, so that the clamped position can only be opened against the action of the spring force. The clamping function here is released exclusively by a manual application of force, which runs parallel to the surface of the component to be screwed.

In a particularly advantageous embodiment of the invention, this is achieved in that each support segment of the cross-member is equipped with a handle tab, each of which can be moved towards the other in linear manner and parallel to the clamping axis, against the resistance of the spring device. To allow the linear movement, it is preferably envisaged that the handle tab of the first support segment passes through a casing window of the second support segment and can be moved within the latter along the clamping axis. The largest clamping width of the clamping blocks is reached as soon as both handle tabs rest parallel against each other. While the distance between the two handle tabs is reduced, the clamping width between the clamping blocks is increased. The fact that both handle tabs come up against each other therefore prevents the spring from being overextended.

BRIEF DESCRIPTION OF THE DRAWINGS

There are various options for arranging and developing the gauge of the present invention advantageously. In that regard reference is made on the one hand to the following claims and on the other hand to the following commentary on a model embodiment of the invention aided by the drawing. In conjunction with the commentary on the preferred model embodiment of the invention aided by the drawing, generally preferred arrangements and developments of the gauge are also explained.

The drawing shows.

DETAILED DESCRIPTION OF THE PREFERRED EMBODIMENTS

Figure 1:
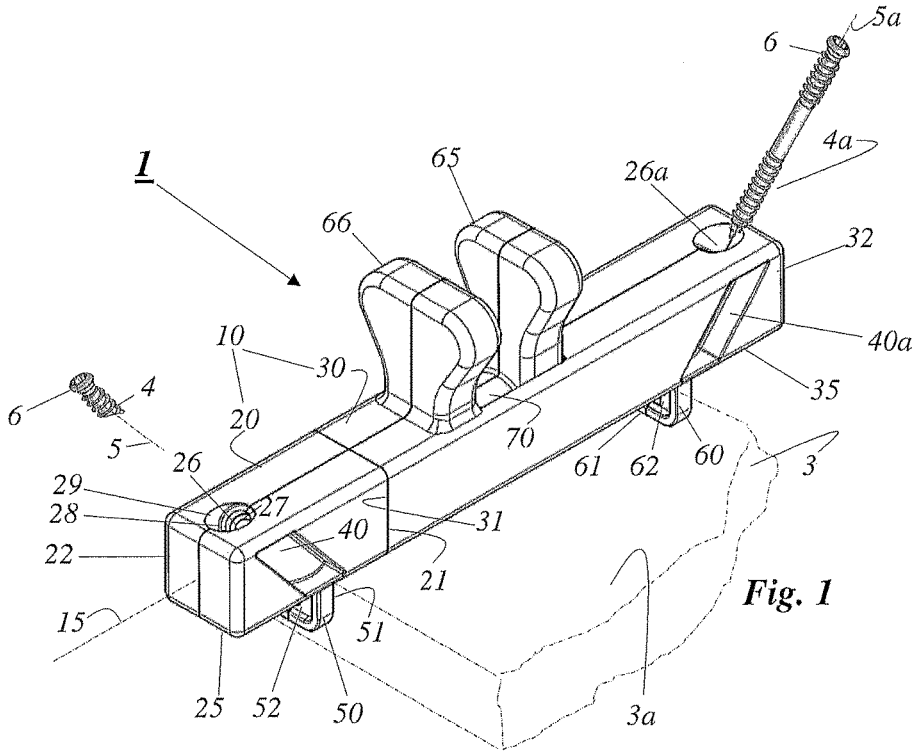
FIG. 1 a perspective view of the screw installation aid according to the invention, FIG. 2 a side view of the screw installation aid, FIG. 3 a top view of the screw installation aid, FIG. 4 the opened screw installation aid, and FIG. 5 a top view of the representation from FIG. 4.
Figure 2:
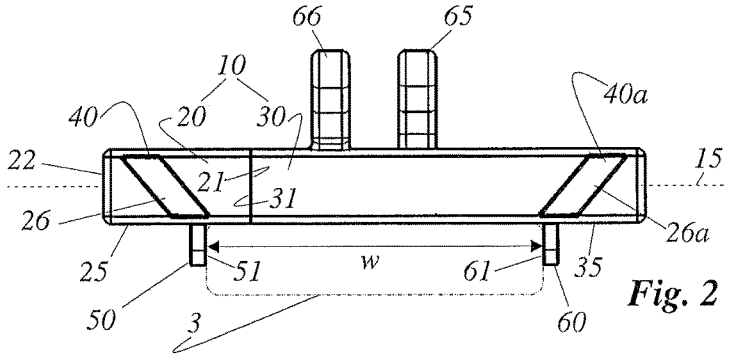
Figure 3:
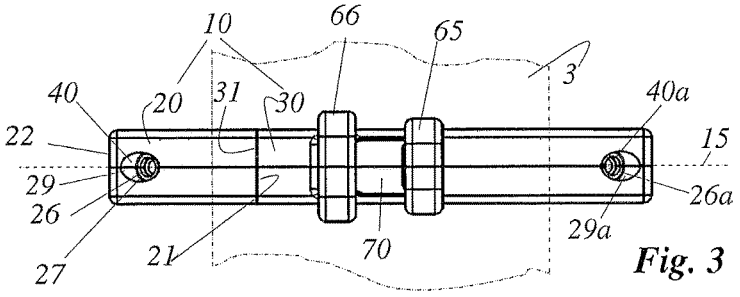

The screw installation aid 1 according to the invention comprises two telescopically assembled support segments 20, 30, which each contain a screw guide 40, 40*a* and together form a cross-member 10. Both support segments 20, 30 possess congruent end surfaces 21, 31, with which they rest against each other. To that end the support segments 20, 30 are joined together coaxially with a common clamping axis 15 passing through them in a longitudinal direction.

The first support segment 20 possesses a cuboid head section 22, which on its end surface 21 carries a tubular pin 24 (FIG. 4), which extends in a longitudinal direction along the clamping axis 15. The head section 22 encloses the screw guide 40, which possesses a duct 26 inclined at about 45° relative to the end surface 21, through which the screw axis 5 of a screw 4 inserted in duct 26 leads. Duct 26 houses a guide sleeve 27. The freedom of movement of the guide sleeve 27 is restricted by annular collars 28 on both sides of the duct 26, each of which is situated on the base of openings 29 located on the free ends of the duct 26.

Figure 4:
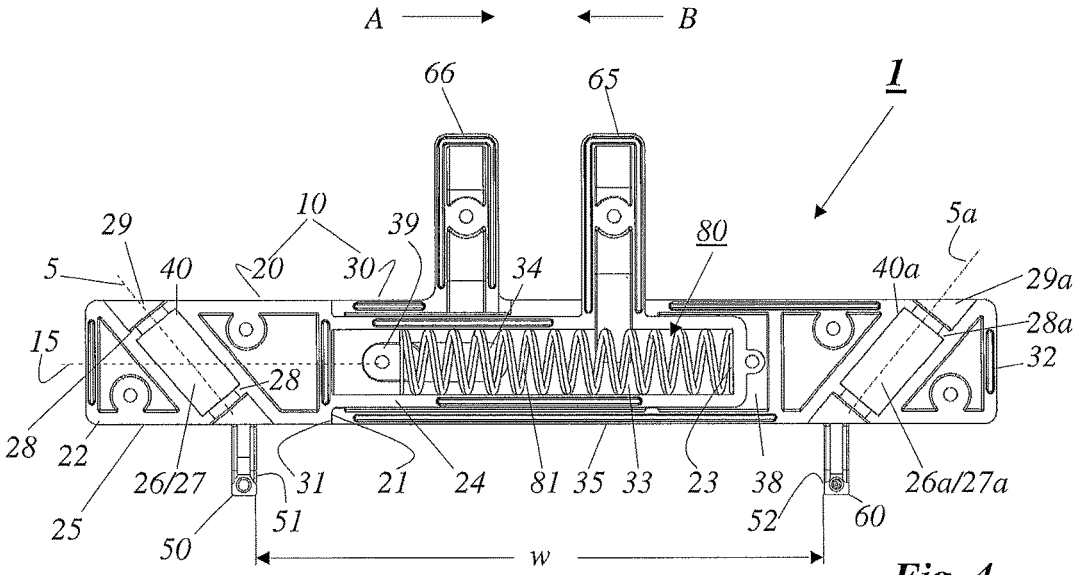

As is evident particularly in FIG. 4, the tubular pin 24 within its tube chamber 33 houses a spring 81, which is supported at one of its ends on the inner end wall of the pin 23 and at its other end on a driver 39. The driver sits on the inner wall of a chamber 38 of the second support segment 30 in which the pin 24 of the first support segment 20 can be moved coaxially along the common clamping axis 15. A further head section 32 that encloses a second screw guide 40*a* joins onto the casing of the chamber 38 with a congruent cross-section. The structure of the head section 32 of the second support segment 30 and of the screw guide 40*a* located inside it corresponds to the arrangement in the opposite head section 22 of the first support segment 20 in mirror image, in other words rotated horizontally through 180°.

Accordingly, the head section 32 encloses the screw guide 40*a*, which possesses a duct 26*a* inclined at about 45° relative to the end surface 31, through which the screw axis 5*a* of a screw 4*a* inserted in duct 26*a* leads. Here again, duct 26*a* houses a guide sleeve 27*a*. The freedom of movement of the guide sleeve 27*a* is similarly restricted by annular collars 28*a* on both sides of the duct 26*a*, each of which is situated on the base of openings 29*a* located on the free ends of the duct 26*a*.

The driver 39 of the second support segment 30 is guided inside a slot 34 that penetrates the wall of the pin, as a result of which the linear movement path of both support segments 20, 30 relative to each other and therefore the clamping width "w" of the clamping blocks 50, 60 is restricted. The latter are each located on the undersides 25, 35 of the two support segments 20, 30 and move synchronously to these when the working length of the cross-member 10 or the clamping width "w" of clamping blocks 50, 60 is changed by compressing the handle tabs 65, 66 of both support segments 20, 30 against the resistance of the spring device 80 formed by the spring 81, the inner end wall of the pin 23 and the driver 39.

Figure 5:
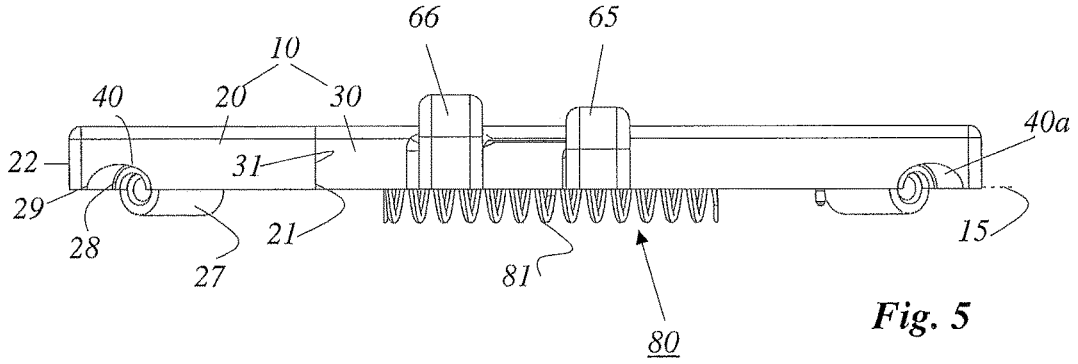

Both the first and second support segments 20 and 30 that form the cross-member 10 consist of two half-shells bolted together, as is clearly identifiable in FIG. 5. This allows their relatively easy manufacture as well as the subsequent assembly of all component parts of the cross-member or screw installation aid according to the invention, in which the spring device 80 is encapsulated and the cross-member sections are connected to each other movably but inseparably.

In order now to fasten a component 3, such as e.g. a decking board, to a substructure, the screw installation aid 1 according to the invention is placed on the component 3 to be screwed such that the cross-member 10 rests with the undersides 25, 35 of the support segments 20, 30 on the surface 3*a* of the component 3. For this process, first the clamping width "w" between the opposite inner sides 51, 61 of both clamping blocks 50, 60 is increased by both handle tabs 65, 66 being moved towards each other in the direction of the arrows "A" and "B".

The two support segments 20, 30 of the cross-member 10 and their clamping blocks 50, 60 are now spread apart and are preloaded by the spring action, as a result of which they move back towards each other when the handle tabs 65, 66 are released, and the component is clamped between the clamping blocks 50, 60.

As a result, both support segments 20, 30 of the cross-member 10 are preloaded and move apart as a result of the spring resistance when the handle tabs are released and automatically return to their home positions. The component to be screwed is clamped between the clamping blocks 50, 60 in the process. The clamping force is sufficient to perform the screwing process unhindered, with the option of additionally pressing the cross-member against the component manually.

LIST OF REFERENCE SYMBOLS

1 Screw installation aid
3 Component to be screwed
3*a* Surface of 3
4 Screw
4*a* Screw
5 Screw axis
5*a* Screw axis
6 Screw head
10 Cross-member
15 Clamping axis of 10, 20 and 30
20 First support segment
21 End surface of 20
22 Head section of 20
23 Pin end wall
24 Pin of 20
25 Underside of 20
26 Duct of 40
26*a* Duct of 40*a*
27 Guide sleeve in 26
27*a* Guide sleeve in 26*a*
28 Annular collar
28*a* Annular collar
29 Opening of 26
29*a* Opening of 26*a*
30 Second support segment
31 End surface of 30
32 Head section of 30
33 Tube chamber of 24
34 Slot of 24
35 Underside of 30
36 Opening on 31
38 Chamber of 30
39 Driver
40 Screw guide in 20
40*a* Screw guide in 30
50 Clamping block
51 Inner side of 50
52 Window in 50
60 Clamping block
61 Inner side of 50
62 Window in 60
65 Handle tab
66 Handle tab
70 Casing window
80 Spring device
81 Spring

The invention claimed is:

1. A screw installation aid for holding and aligning a screw in an inclined screw axis relative to the component to be screwed, with at least one screw guide, in which the screw is received in the inclined screw axis, and which has an opening through which a screwing tool can be advanced to the screw head coaxially to the screw axis, in order to install the screw in the component in its inclined position, wherein the screw installation aid can be adapted to the component in that it possesses first and second clamping blocks that are adjustable relative to one another, the adjacent inner sides of which limit a clamping width "w" and which, during the screwing process, clamp the component to be screwed, wherein the screw installation aid encompasses a telescopic cross-member that comprises at least two support segments that can be adjusted coaxially to one another, the undersides of which facing the component to be screwed form a level and, before adaptation to the component, continuous support surface and with each of the undersides bearing one of the clamping blocks, wherein the clamping blocks can be positioned from a home position to an opening position against the resistance of a spring device between both support segments, wherein the at least one screw guide is enclosed in at least one of the support segments, wherein the first support segment bears on its end surface a tubular pin, which extends in a longitudinal direction along the clamping axis, and the second support segment exhibits on its end surface an opening that receives the pin, wherein the tubular pin of the first support segment is received inside a chamber of the second support segment and can be moved coaxially relative to the common clamping axis, and wherein the tubular pin within its tube chamber houses a spring, which is supported at one of its ends on the inner end wall of the pin and at its other end on a driver arranged on the inner wall of the chamber of the second support segment.

2. The screw installation aid according to claim 1, wherein the screw axis passes through a first window arranged in the first clamping block.

3. The screw installation aid according to claim 1, wherein both support segments possess parallel end surfaces with which they rest against each other, wherein the support segments are joined together coaxially with a common clamping axis passing through them in a longitudinal direction.

4. The screw installation aid according to claim 1, wherein the driver of the second support segment is guided in a slot that penetrates the wall of the pin of the first support segment, and protrudes into the tube chamber of the tubular pin.

5. The screw installation aid according to claim 1, wherein each support segment of the cross-member is equipped with a handle tab, each of which can be moved towards the other in linear manner and parallel to the clamping axis, against the resistance of the spring device.

6. The screw installation aid according to claim 5, wherein the handle tab of the first support segment passes through a casing window of the second support segment and can be moved within the latter along the clamping axis.

* * * * *